US010149070B2

(12) United States Patent
Desloge et al.

(10) Patent No.: US 10,149,070 B2
(45) Date of Patent: Dec. 4, 2018

(54) NORMALIZING SIGNAL ENERGY FOR SPEECH IN FLUCTUATING NOISE

(71) Applicant: MASSACHUSETTS INSTITUTE OF TECHNOLOGY, Cambridge, MA (US)

(72) Inventors: Joseph G. Desloge, San Francisco, CA (US); Charlotte M. Reed, Arlington, MA (US); Louis D. Braida, Arlington, MA (US)

(73) Assignee: Massachusetts Institute of Technology, Cambridge, MA (US)

( * ) Notice: Subject to any disclaimer, the term of this patent is extended or adjusted under 35 U.S.C. 154(b) by 133 days.

(21) Appl. No.: 15/410,222

(22) Filed: Jan. 19, 2017

(65) Prior Publication Data

US 2017/0208399 A1 Jul. 20, 2017

Related U.S. Application Data

(60) Provisional application No. 62/280,197, filed on Jan. 19, 2016.

(51) Int. Cl.
*H04R 25/00* (2006.01)

(52) U.S. Cl.
CPC ..... *H04R 25/505* (2013.01); *H04R 2225/41* (2013.01); *H04R 2225/43* (2013.01)

(58) Field of Classification Search
CPC ..... H04R 25/505; H04R 2225/41; H04R 2225/43
See application file for complete search history.

(56) References Cited

U.S. PATENT DOCUMENTS 7,149,320 B2 * 12/2006 Haykin ..... H04R 25/407 381/320
2015/0264482 A1 * 9/2015 Neely ..... H04R 25/353 381/320
2017/0311094 A1 * 10/2017 Andersen ..... H04R 25/50

OTHER PUBLICATIONS

De Gennaro, S., L. D. Braida, and N. I. Durlach. "Multichannel syllabic compression for severely impaired listeners." Journal of Rehabilitation Research and Development 23, No. 1 (1986): 17-24.
Desloge, Joseph G., William M. Rabinowitz, and Patrick M. Zurek. "Microphone-array hearing aids with binaural output. I. Fixed-processing systems." IEEE Transactions on Speech and Audio Processing 5, No. 6 (1997): 529-542.
Healy, Eric W., Sarah E. Yoho, Yuxuan Wang, and DeLiang Wang. "An algorithm to improve speech recognition in noise for hearing-impaired listeners." The Journal of the Acoustical Society of America 134, No. 4 (2013): 3029-3038.
Kennedy, Elizabeth, Harry Levitt, Arlene C. Neuman, and Mark Weiss. "Consonant-vowel intensity ratios for maximizing consonant recognition by hearing-impaired listeners." The Journal of the Acoustical Society of America 103, No. 2 (1998): 1098-1114.
(Continued)

*Primary Examiner* — Brian Ensey
(74) *Attorney, Agent, or Firm* — Occhiuti & Rohlicek LLP

(57) ABSTRACT

An approach to audio processing aims to improve intelligibility by amplifying time segments of an input signal when the level of the signal falls below a long-term average level of the input signal, for instance, introducing a time-varying gain such that the signal level of the amplified segment matches the long-term average level.

18 Claims, 6 Drawing Sheets

(56) References Cited

OTHER PUBLICATIONS

Léger, Agnès C., Charlotte M. Reed, Joseph G. Desloge, Jayaganesh Swaminathan, and Louis D. Braida. "Consonant identification in noise using Hilbert-transform temporal fine-structure speech and recovered-envelope speech for listeners with normal and impaired hearing a." The Journal of the Acoustical Society of America 138, No. 1 (2015): 389-403.

Lim, Jae S., and Alan V. Oppenheim. "Enhancement and bandwidth compression of noisy speech." Proceedings of the IEEE 67, No. 12 (1979): 1586-1604.

Lippmann, R. P., L. D. Braida, and N. I. Durlach. "Study of multichannel amplitude compression and linear amplification for persons with sensorineural hearing loss." The Journal of the Acoustical Society of America 69, No. 2 (1981): 524-534.

Moore, Brian CJ, Thomas H. Stainsby, José I. Alcàntara, and Volker Kühnel. "The effect on speech intelligibility of varying compression time constants in a digital hearing aid." International Journal of Audiology 43, No. 7 (2004): 399-409.

Nordqvist, Peter, and Arne Leijon. "Hearing-aid automatic gain control adapting to two sound sources in the environment, using three time constants." The Journal of the Acoustical Society of America 116, No. 5 (2004): 3152-3155.

Reed, Charlotte M., Joseph G. Desloge, Louis D. Braida, Zachary D. Perez, and Agnès C. Léger. "Level variations in speech: Effect on masking release in hearing-impaired listeners a." The Journal of the Acoustical Society of America 140, No. 1 (2016): 102-113.

Souza, Pamela E., Kumiko T. Boike, Kerry Witherell, and Kelly Tremblay. "Prediction of speech recognition from audibility in older listeners with hearing loss: effects of age, amplification, and background noise." Journal of the American Academy of Audiology 18, No. 1 (2007): 54-65.

Stone, Michael A., Brian CJ Moore, José I. Alcántara, and Brian R. Glasberg. "Comparison of different forms of compression using wearable digital hearing aids." The Journal of the Acoustical Society of America 106, No. 6 (1999): 3603-3619.

Braida, L. D., N. I. Durlach, S. V. De Gennaro, P. M. Peterson, D. K. Bustamante, G. Studebaker, and F. Bess. "Review of recent research on multiband amplitude compression for the hearing impaired." The Vanderbilt hearing aid report (1982): 133-140.

Bustamante, Diane K., and Louis D. Braida. "Principal-component amplitude compression for the hearing impaired." The Journal of the Acoustical Society of America 82, No. 4 (1987): 1227-1242.

* cited by examiner

NORMALIZING SIGNAL ENERGY FOR SPEECH IN FLUCTUATING NOISE

CROSS-REFERENCE TO RELATED APPLICATIONS

This application claims the benefit of U.S. Provisional Application No. 62/280,197, filed Jan. 19, 2016, the contents of which are incorporated herein by reference.

STATEMENT AS TO FEDERALLY SPONSORED RESEARCH

This invention was made with government support under Award Number R01 DC000117 awarded by National Institute on Deafness and Other Communication Disorders of the National Institutes of Health. The government has certain rights in the invention.

BACKGROUND

This invention relates to normalizing signal energy of an audio signal in fluctuating noise or other interferences, and more particularly to applying such normalization for processing a speech signal for a hearing impaired listener.

Listeners with sensorineural hearing impairment (hereinafter "HI listeners") who are able to understand speech in quiet environments generally require a higher speech-to-noise ratio (SNR) to achieve criterion performance when listening in background interference than do listeners with normal hearing (hereinafter "NH listeners"). This is the case regardless of whether the noise is temporally fluctuating, such as interfering voices in the background, or is steady, such as a fan or motor noise. For NH listeners, better speech reception is observed in fluctuating-noise backgrounds compared to continuous noise of the same long-term root-mean-square (RMS) level, and they are said to experience a "release from masking."

In general, masking occurs when perception of one sound is affected by the presence of another sound. For example, the presence of a more intense interference may affect the perception of a less intense signal. For example, in "forward" masking, an intense interference may raise a perception threshold for approximately 20 ms. after the interference ends. Masking release is the phenomenon where a speech signal is better recognized in the presence of an interference with a fluctuating level than in the presence of a steady interference of the same RMS level. Masking release may arise from the ability to perceive "glimpses" of the target speech during dips in the fluctuating noise, and it aids in the ability to converse normally in the noisy social situations mentioned above. A quantitative measure of masking release is defined in terms of a recognition score (e.g., percent correct), for example, in a consonant recognition task, in quiet, a steady interference, and a fluctuating interference. For example, a Normalized measure of Masking Release (NMR) may be defined as the ratio of (Score in fluctuating interference minus Score in steady interference) and (Score in without interference minus Score in steady interference). Another measure for masking release compares, for a given speech signal, an average level of fluctuating interference and a level of continuous interference (i.e., a dB difference) to achieve the same score.

Studies conducted with HI listeners have shown reduced (or even absent) release from masking compared to that obtained with NH listeners. For example, in one study a speech signal at 80 dB SPL could be recognized by NH listeners at 50%-correct reception of sentences in in a fluctuating interference, specifically a 10-Hz square-wave interrupted noise, at a level 13.9 dB greater than with a continuous level. However, for HI listeners the difference was only 5.3 dB. Therefore, although the HI listeners in the study were able to benefit from the fluctuation, the degree of that benefit was substantially less than for NH subjects.

One approach to processing speech (or speech in the presence of interference) of varying level make use of compression amplification. In compression amplification, lower-energy components receive greater boost than higher-energy components. This processing is used to match the range of input signal levels into a reduced dynamic range of a listener with sensorineural hearing loss. Compression amplification is generally based on the actual sound-pressure level (SPL) of the input signal. Compression aids are often designed to use fast-attack and slow-release times resulting in compression amplification that operates over multiple syllables. Some studies have shown that compression systems do not yield performance better than that obtained with linear-gain amplification in either continuous or fluctuating noise.

Referring to FIG. 1, an audio system 100 (e.g., a hearing aid) includes an audio processor 120 that processes audio produced by a speaker 110 and captured using a microphone 112 and drives a hearing aid transducer 132 (e.g., a speaker coupled to a listener's ear canal) for presentation of processed audio to a listener 130. In this example, the audio processor may provide linear time invariant (LTI) transformation of the signal to match the listener's frequency-dependent threshold and comfort profile. Furthermore, in the case of a compression-based hearing aid, the audio processor implements a (non-linear) compression response 122 in which higher input power is attenuated relative to lower input power, as a consequence reducing the dynamic range of the signal presented to the listener as compared to the dynamic range received at the microphone. Generally, in such a compression-based processing, a reduction in gain has a fast response with a time constant in the order of 10 ms., while subsequent increase in gain (e.g., after a loud event has passed) increases with a slow response with a time constant in the order of 100 ms or more.

There is a need to improve intelligibility for HI listeners of speech in the presence of fluctuating interference beyond what is attainable using conventional audio processing approaches, including attainable using conventional compression-based approaches.

SUMMARY

In a general aspect, an approach to audio processing, hereinafter referred to as "energy equalization" (EEQ), aims to improve intelligibility by amplifying time segments of an input signal when the level of the signal falls below a long-term average level of the input signal. For instance, a time-varying gain is introduced such that the signal level of the amplified segment matches the long-term average level. In some examples, the gain is adjusted with a response time of 5 ms., while the long-term average is computed over a duration in the order of 200 ms. Note that the response time may be shorter than the forward masking time, and therefore may improve the ability to perceive relatively weak sounds that follow a reduction in an interferences level. The long-term average duration may be chosen to be sufficiently long to maintain a relatively smooth overall level variation. The approach can react rapidly based on the short-term energy estimate, and is capable of operating within a single syllable to amplify less intense portions of the signal relative to more intense ones. In some examples, the gain is limited to be greater than 0.0 dB (signal multiplication by 1.0) and less than a maximum gain, for example, 20 dB.

Aspects may include one or more of the following features.

The approach to audio processing is incorporated into a hearing aid (e.g., an audio hearing aid, cochlear implant, etc.). In some examples, EEQ is applied to an input signal prior to processing the signal using linear time invariant (LTI) filtering, amplitude compression, or other conventional audio processing used in hearing aids. Alternatively, EEQ is applied after other conventional audio processing, for example, after LTI filtering.

In another aspect, in general, an audio signal is processed for presentation to a hearing-impaired listener. The processing includes acquiring the input signal in an acoustic environment. The input signal comprises a speech signal of a first speaker and an interfering signal at an average level greater than an average level of the speech signal. The interfering signal has a fluctuating level. An average level of the input signal is tracked over a first averaging duration producing a time-varying first average signal level. The first averaging duration is greater than or equal to 200 milliseconds. An average level of an input signal is also tracked over a second averaging duration producing a time-varying second average signal level. The second averaging duration is less than or equal to 5 milliseconds. A first time-varying gain is determined as a ratio of the first average signal level and the second average signal level. A second time-varying gain is then determined by limiting the first time-varying gain to a limited range of gain, the limited gain of range excluding attenuation. The second time-varying gain is applied to the input signal to produce a processed input signal, which is then provided to the hearing-impaired listener.

In another aspect, in general, a method for processing an audio signal comprises applying an audio processing process to the signal. The audio processing process includes tracking an average level of an input signal over a first averaging duration producing a time-varying first average signal level and tracking an average level of an input signal over a second averaging duration producing a time-varying second average signal level, wherein the second averaging duration is substantially shorter than the first averaging duration. A first time-varying gain is determined according to a degree to which the first average signal level is greater than the second average signal level, and a second time-varying gain is determined by limiting the first time-varying gain to a limited range of gain. The second time-varying gain is applied to the input signal producing a processed input signal.

Aspects may include one or more of the following features.

The method includes receiving the input signal, where the first signal comprises a speech signal of a first speaker and an interfering signal at an average level greater than an average level of the speech signal, and the interfering signal has a fluctuating level. The input signal may be acquired in an acoustic environment, and the processed input signal may be provided for presentation to a hearing-impaired listener. For instance, providing the processed input signal to the listener comprises driving an acoustic transducer according to the processed input signal.

The method further includes further processing of the processed input signal. This further processing includes at least one of applying a linear time-invariant filter to said signal and applying an amplitude compression to said signal.

Tracking the average level of an input signal over the first averaging duration comprises applying a first filter to an energy of the input signal (e.g., to the square of the signal), the first filter having an impulse response characterized by a duration or time constant equal to the first averaging duration, and tracking the average level of an input signal over the second averaging duration comprises applying a second filter to the energy of the input signal, the second filter having an impulse response characterized by a duration or time constant equal to the second averaging duration. For example, the first filter and the second filter each comprises a first order infinite impulse response filter.

An average level of the processed input signal is adjusted to match the first average signal level.

The method further includes decomposing the input signal into a plurality of component signals, each component signal being associated with a different frequency range. The processing is applied to each of the component signals producing a plurality of processed component signals, which are then combining. The processing for each frequency range may be the same, or may differ, for example, with different averaging durations.

In another aspect, in general, an audio processing apparatus comprises an audio processor that includes a first level filter configured to track an average level of an input signal over a first averaging duration producing a time-varying first average signal level, a second level filter configured to track an average level of an input signal over a second averaging duration producing a time-varying second average signal level, wherein the second averaging duration is substantially shorter than the first averaging duration, a gain determiner configured to determine a first time-varying gain according to a degree to which the first average signal level is greater than the second average signal level, and to determine a second time-varying gain by limiting the first time-varying gain to a limited range of gain, and a multiplier configured to apply the second time-varying gain to the input signal producing a processed input signal. The apparatus also includes a signal acquisition module coupled to a microphone for sensing an acoustic environment, and coupled to an input of the audio processor via a first signal path, and a signal presentation module coupled to a transducer for presenting an acoustic or neural signal to a listener, and coupled to an output of the audio processor via a second signal path.

Aspects may include one or more of the following features.

The audio processor further comprises at least one of a linear time-invariant filter and an amplitude compressor on either the first signal path or the second signal path.

The audio processor includes a programmable signal processor, and a storage for instructions for the signal processor.

In another aspect, in general, a non-transitory machine-readable medium comprises instructions for causing a processor to process an audio signal by tracking an average level of an input signal over a first averaging duration producing a time-varying first average signal level, tracking an average level of an input signal over a second averaging duration producing a time-varying second average signal level, wherein the second averaging duration is substantially shorter than the first averaging duration, determining a first time-varying gain according to a degree to which the first average signal level is greater than the second average signal level, determining a second time-varying gain by limiting the first time-varying gain to a limited range of gain, and applying the second time-varying gain to the input signal producing a processed input signal.

Aspects can include advantages including increasing the comprehension of speech in a fluctuating noise level environment, and in particular, increasing comprehension for hearing impaired listeners.

The processing outlined above is also applicable to "clean" signals in which there is no fluctuating interferences. One advantage of such processing is that the "consonant/vowel (CV) ratio," which characterizes the relative level of consonants and vowel, may be increased, thereby improving perception and/or recognition accuracy for consonants. Note that when used as a technique for modifying the CV ratio, there is no need to explicitly identify the time extent of particular consonants and vowels in the signal being processed.

Other features and advantages of the invention are apparent from the following description, and from the claims.

DESCRIPTION

Figure 1:
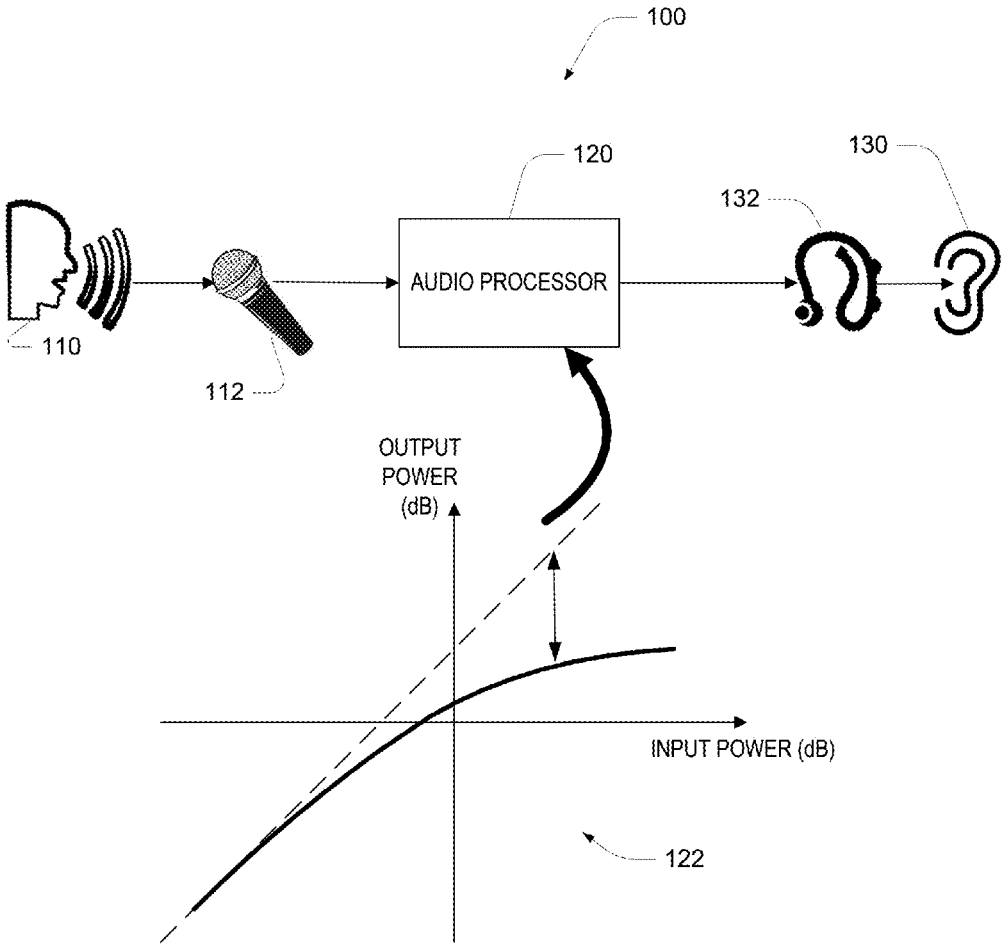
FIG. 1 (PRIOR ART)
FIG. 1 is a block diagram of an audio system including an amplitude compression function.
Figure 2:
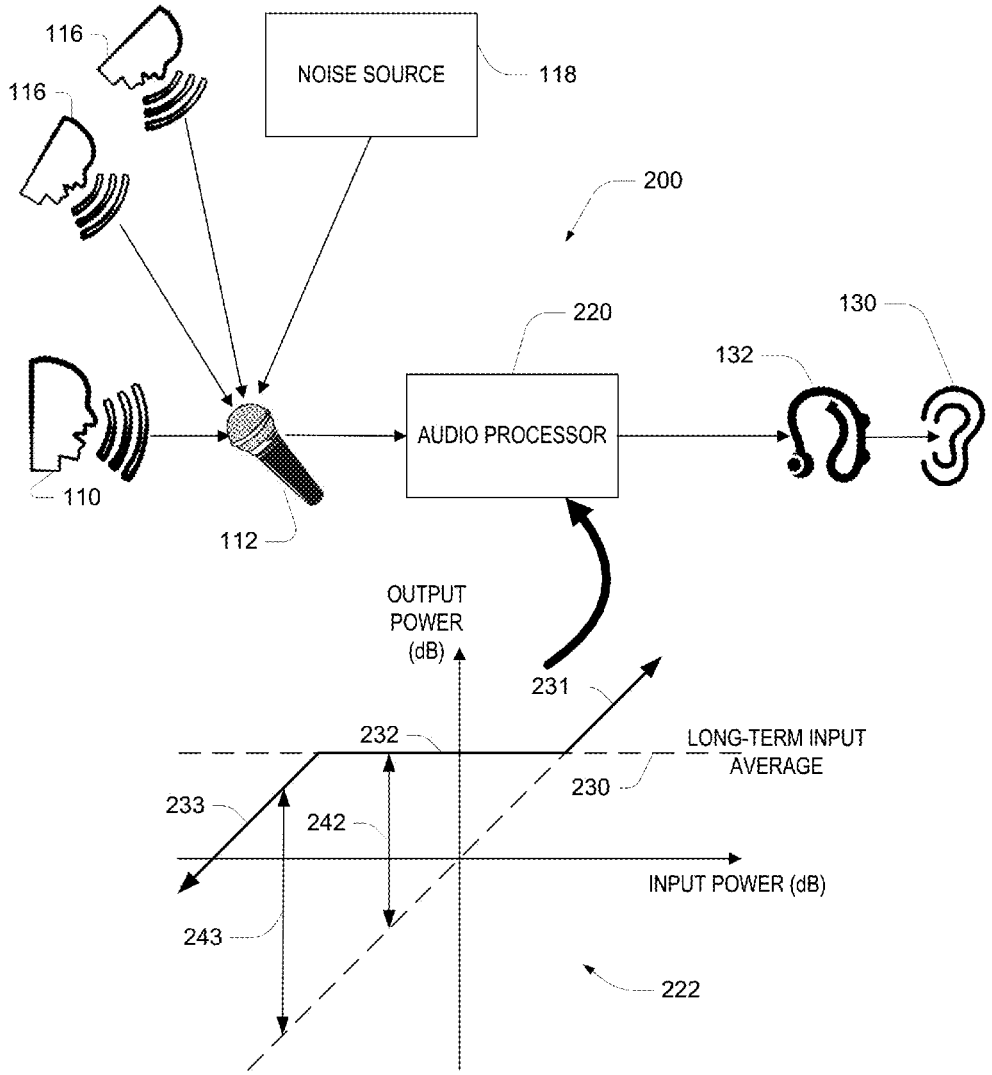
FIG. 2 is a block diagram of an audio system including an energy equalization function.

Referring to FIG. 2, an example of an audio processing system 200 is presented in the context of processing an acquired audio signal in a hearing aid for presentation to a hearing impaired (HI) listener. As in a conventional approach illustrated in FIG. 1, the hearing aid captures audio produced by a speaker 110 using a microphone 112, which produces an audio signal (e.g., and electrical or data signal) and drives a hearing aid transducer 132 for presentation of processed audio to a HI listener 130. As is described in detail in this document, in this example an audio processor 220 implements a signal processing approach in which certain portions of the audio signal are amplified to a level at or relative to a long-term average level of the input signal. A representation of a short term input-output power relationship 222 is shown (plotted in a logarithmic decibel domain). According to this relationship, when the input power is at or above a long-term power level 230 of the input, the output power level is equal to the input power level (segment 231 of the input-output relationship). When the input power level is below the long-term average level, a gain 242 is applied. The gain 242 is selected to yield an output level equal to the long-term average of the input, up to a maximum gain 243 (segment 232 of the input-output relationship). That is, below a certain input level (relative to the average input level) a fixed maximum gain 243 is applied (segment 233 of the input-output relationship); up to the long-term input level a gain sufficient to amplify the input to the long-term level is applied; and above the long-term average, a unit gain is applied. Note that the illustrated relationship 222 does not represent dynamic aspects of the relationship, which are described below. Note also in general, the input-output relationship 222 may reduce the dynamic range of the output signal relative to the input signal, which may be considered to be a form of compression. However, it should be appreciated that the way the dynamic range may be reduced uses an entirely different approach than conventional amplitude compression techniques, which results in different perception of the input speech by a HI listener. The goal of the present approach is to increase comprehension as compared to prior approaches.

One aspect of the system 200 relates to the processing of an input signal in which the speech of a desired speaker 110 is in an environment in which other speakers 116 or another noise source 118 (e.g., a mechanical noise source) create interfering audio signals. One aspect of such interfering signals is that the level of such signals may not be constant. Rather, there may be periods (time segments) during which the level of such interfering signals drops significantly (e.g., by 10 dB-20 dB). In general, as introduced in the Background, a NH listener may be able to capture "glimpses" of the speech of the desired speaker 110, therefore gaining some comprehension of what that speaker is saying even if the listener cannot gain full comprehension of the desired speaker's speech during the time segments where the interfering signals have higher levels.

Figure 3A:
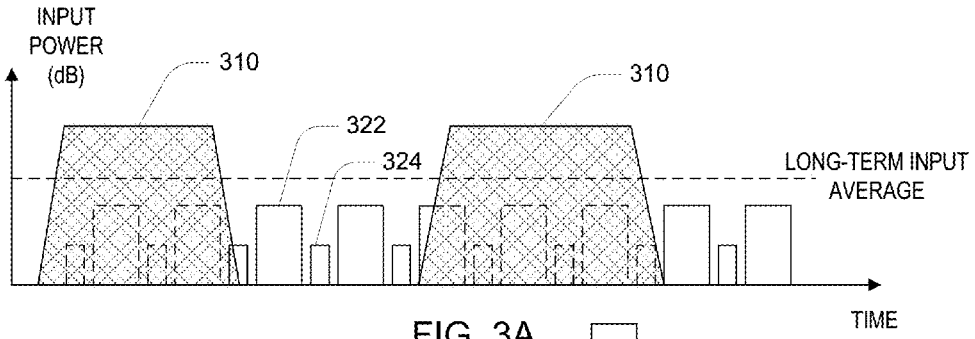
FIGS. 3A and 3B are schematic representations of signal level versus time for an input signal and an output signal, respectively, of the audio system of FIG. 2.
Figure 3B:
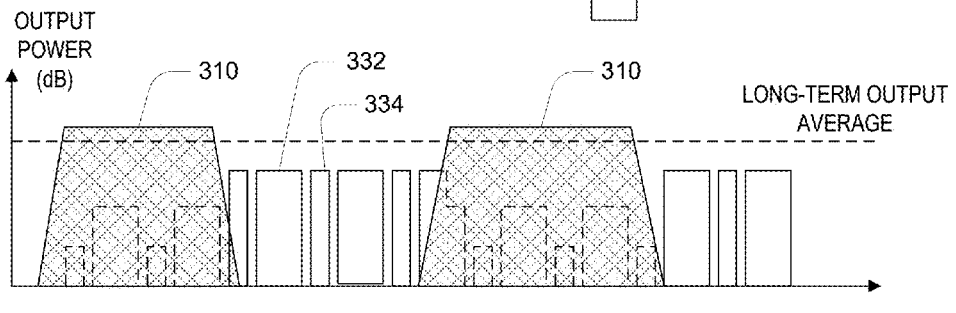

Referring to FIGS. 3A and 3B, a highly stylized schematic of input and output signal levels, respectively, shows signal levels during time segments 310 during which the interfering signals have high levels. In the input signal shown in FIG. 3A, signal levels of parts 322, 324 of a desired speaker's speech are shown at a lower level than a long-term average level for the signal. In general, the desired speaker's speech includes relatively short and low level components 322, for instance representing articulation of consonants, as well are relatively longer and higher level components 324, for instance representing articulations of vowels. Limited dynamic range and/or temporal masking may limit a HI listener to adequately perceive the short, low-level components 322, and possibly the relatively longer and higher-level components 324 as well.

FIG. 3B illustrates a desired transformation of the input signal to the output signal of the audio system (e.g., the signal presented via the hearing aid to the HI listener). In this stylized schematic, the level of the components 322, 324 is increased to reach the long-term average input level. By increasing the level of these components, the HI listener may be able to better perceive them because they may be above the listener's perceptual threshold, which may be increased due to temporal masking.

Note that the diagrams of FIGS. 3A and 3B are highly stylized and do not illustrate certain phenomena. For instance, the long-term input average is time varying and may decline during the "gaps" in the interference, and may rise during the interference. The diagrams assume that the averaging duration is sufficiently long that such changes in the long-term input average are not substantial. Also, the gain applied to the less intense components 322, 324 is shown to be instantaneous, however it should be understood that in a causal implementation, the gain will increase with a rate limited by a short-term averaging duration in which the signal level is determined. Also, it should be understood that these diagrams do not illustrate situations in which the gain is limited.

Figure 4A:
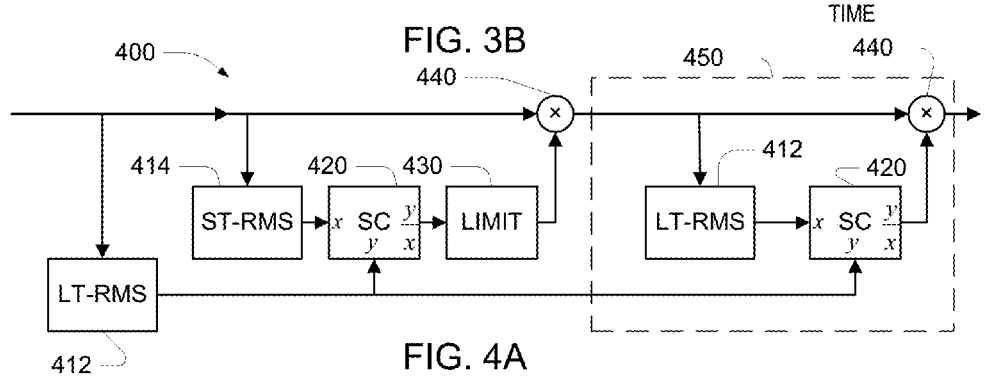
FIGS. 4A and 4B are block diagrams of an implementation of an energy equalization function of the audio system of FIG. 2.
Figure 4B:
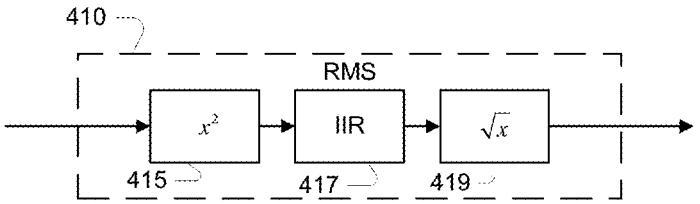

Referring to FIGS. 4A and 4B, a signal processing flow graph for a processing procedure referred to herein as "Energy Equalization" (EEQ) implements an approach that generally causes the effect shown in FIGS. 3A-B and in the input-output relationship 222 shown in FIG. 2. Referring to FIG. 4B, a Root-Mean-Squared (RMS) module 410 accepts an input signal, squares it in a first element 415, applies an infinite-impulse-response (IIR) filter 417, for instance a single-pole filter with a time constant, and then takes the square root 419 of the output of the filter. The IIR filter 417 implements an averaging over a trailing window. The trailing window may be a weighted infinite trailing window that is characterized by an averaging duration. In the case of a one-pole filter, the trailing window is a decaying exponential window, where the averaging duration is characterized by the time constant of the filter. In FIG. 4A, there are two different versions of the RMS module 410 of FIG. 4B, which differ in the time constant of the IIR filter 417. A "short-term" RMS filter, ST-RMS 414, uses a 5 ms. time constant for the filter, while a "long-term" RMS filter, LT-RMS 412, uses a 200 ms. time constant. In general, these time constants are chosen such that the long-term time constant is substantially longer than the low-level "gaps" in the input signal, for instance between the interference segments 310 in FIGS. 3A and 3B, while the short-term time constant is chosen to be shorter than the duration of the relatively short and low-level components 322 (e.g., representing consonants) illustrated in FIG. 3A.

Referring to FIG. 4A, the input signal passes to a LT-RMS module 412, which produces the long-term level of the input signal, and also passes to a ST-RMS module 414, which produces the short term level of the input signal. These two levels are combine in a scaling module (SC) 420 producing the ratio of the long-term level to the short-term level. That is, if the short-term level is lower than the long-term level, the output of the SC module 420 is greater than 1.0. We refer to the output of the SC module as the "raw gain." The raw gain passes to a limit module 430, which limits the raw gain to an actual gain between 0 dB and 20 dB (i.e., multipliers on amplitude between 1.0 and 10). That is, if the raw gain is less than 1.0, the actual gain is set to 1.0 and if the raw gain is greater than 20 dB, then it is set to 20 dB. The actual gain is used to multiply the input signal at a multiplier 440. In some embodiments, the output of this multiplier 440 is used as the output of the EEQ stage. In this embodiment, an optional energy normalization stage 450 is used, which causes the long-term average of the output level to match the long-term average of the input level. To implement this normalization, a LT-RMS module 412 processes the output of the multiplier, and this long-term average is combined with the long-term average of the input signal in a scaling module 420, and this gain is applied in a second multiplier 440.

It should be understood that the implementation shown in FIGS. 4A-4B is only an example. The same result may be achieved by other mathematically equivalent arrangements of modules, or approximated by similar arrangements. For instance, a frequency domain implementation may be used. Furthermore, similar results may be achieved by changing the type of averaging in the RMS modules, for example, using rectangular time averaging windows. Other limits may be used (e.g., other than 0 dB and 20 dB), and a hard-limiting module may be replaced with a soft limiting module, for example, implementing a sigmoid input-output relationship (e.g., a shifted logistic function).

Figure 5:
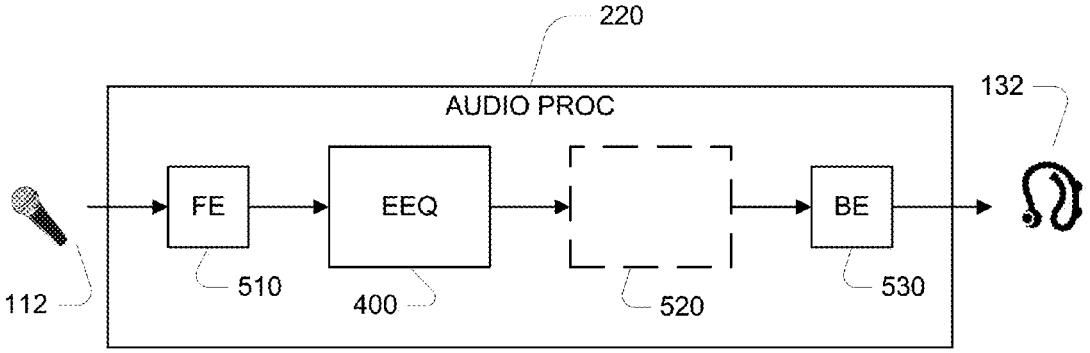
FIG. 5 is a block diagram of an embodiment of an audio processor shown in FIG. 2.

Referring to FIG. 5, the EEQ module 400 of FIGS. 4A-B is included as one module in the signal path of the audio processor 220 introduced in FIG. 2. In this example, the input microphone signal is passed to a front-end (FE) module 510. For example, the FE module amplifies the signal and in digital implementations performs an analog-to-digital conversion (ADC). In this example, the EEQ module 400 processes the output of the FE module 510. The output of the EEQ module 400 is either passed directly to a back-end (BE) module 530, or optionally is first further processed by one or more other signal processing modules 520. Examples of such other modules include linear time-invariance (LTI) filters, which may match the input spectral shape to the HI listener's perception of comfort threshold, and an amplitude compression module, which may implement an input-output relationship 122 as shown in FIG. 1. Other processing modules may also be used on the signal path between the FE module 510 and the EEQ module 400. For example, LTI spectral shaping may be performed prior to the EEQ processing. The BE module 530 is used to drive the hearing aid transducer 132, and may include a digital-to-analog converter (DAC) and amplifier to drive the transducer.

Figure 6:
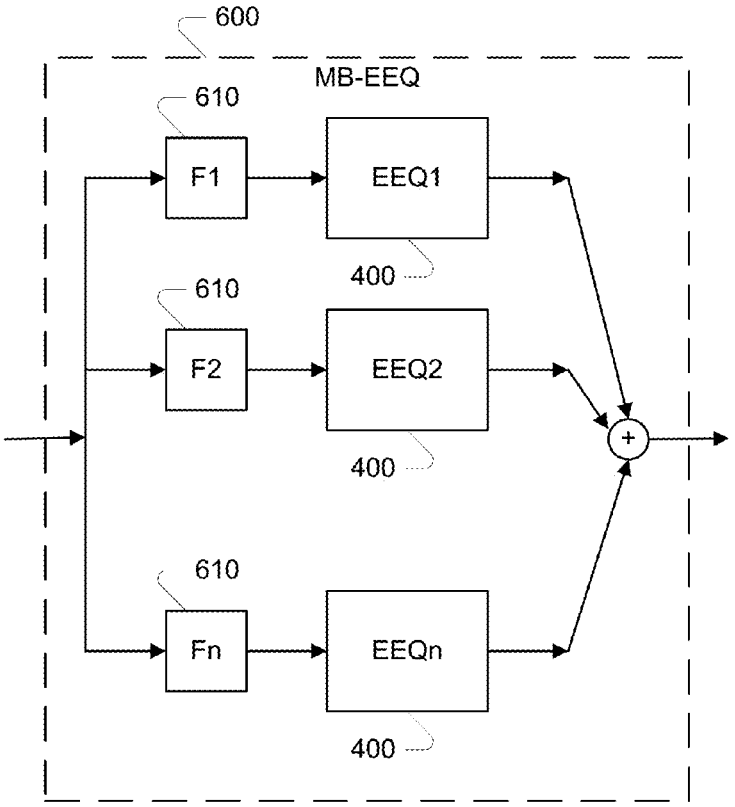
FIG. 6 is a block diagram of an alternative embodiment of an energy equalization function that uses multiple band processing.

The EEQ module 400 of FIG. 5 may be replaced with a multiband EEQ (MB-EEQ) module 600 shown in FIG. 6. In the example of a multiband module of FIG. 6, the input signal passes to a bank of filters F1 610, . . . Fn 610, each of which outputs the component of the input signal in a different substantially non-overlapping frequency band (e.g., equal width frequency bands). The output of each filter 610 passes to an independent EEQ module 400, and the outputs of the EEQ modules 400 are summed to yield the output of the MB-EEQ 600. Other forms of multi-band processing may also be used. The gains introduced in each EEQ 400 may be coupled or constrained to maintain approximately the same spectral shape between the input and the output of the MB-EEQ, for example, requiring that the gains applied in each of the bands are within a limited range of one another. The EEQ modules for each band are not necessarily identical. For example, the short-term averaging duration may be shorter for high-frequency bands than for low frequency bands. As introduced above, the MB-EEQ may be implemented in the frequency domain whereby the FE module performs a frequency analysis (e.g., a Fast Fourier Transform, FFT, of successive windows), and the filters and EEQ modules and the summation are performed in the frequency domain, and finally the BE module performs inverts the frequency analysis (e.g., an Inverse FFT, IFFT, using an overlap-add combination approach).

An EEQ based processing has been applied to speech signals and masking release was measured in a consonant recognition task in which 16 different consonants appear in a fixed Vowel-Consonant-Vowel (VCV) context (i.e., the same vowel V for all the stimuli). Specifically, the consonants comprised C=/p t k b d g f s ʃv z d3 m n r l/ and fixed vowel was V=/α/.

Figure 7A:
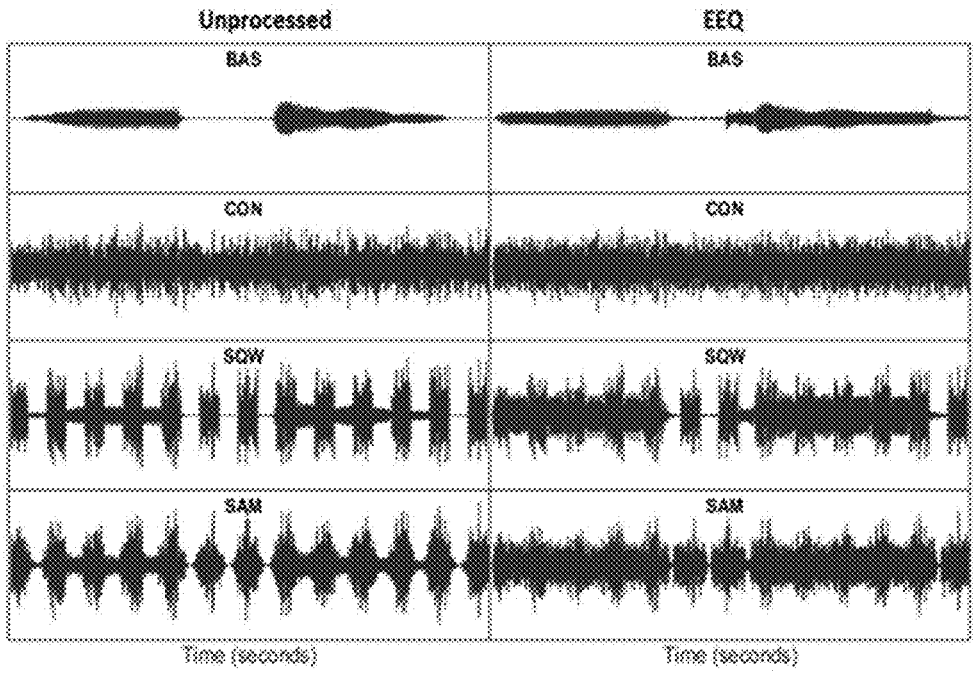
FIG. 7A includes time waveforms of a speech signal unprocessed and after processing, in a baseline and interference conditions.
Figure 7B:
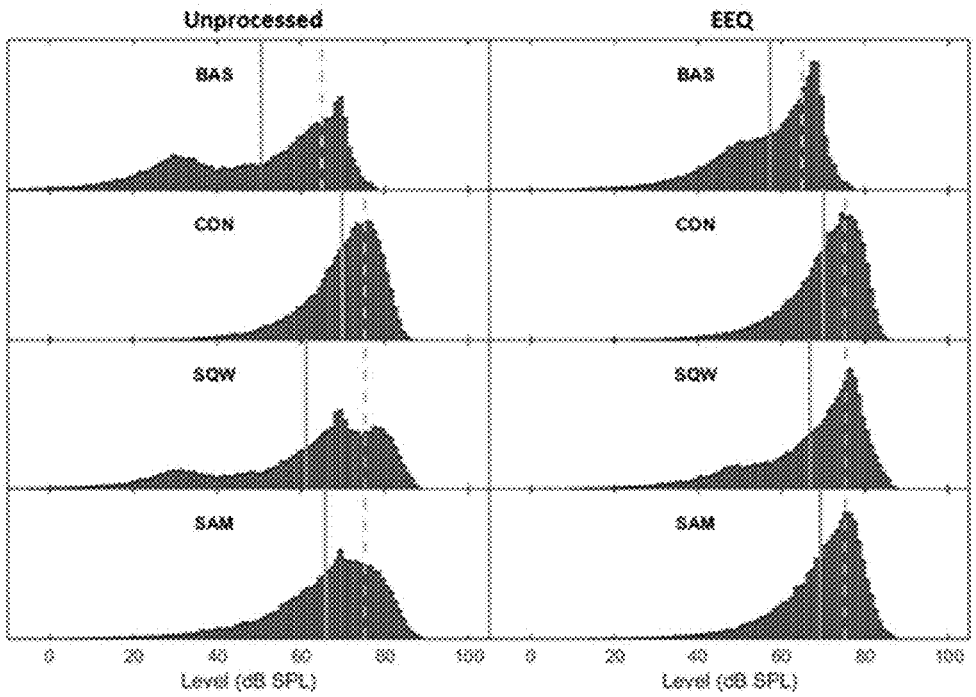
FIG. 7B are graphs of amplitude distributions in the conditions shown in FIG. 7A.

Referring to FIGS. 7A and 7B, waveforms and amplitude distribution plots for the VCV token /αpα/ are shown. FIG. 7A shows four different kinds of background interference with unprocessed (UNP) in the left panels and EEQ processed waveforms in the right panels for a baseline (BAS) and three interference conditions: a baseline noise consisting of continuous speech-shaped noise at 30 dB SPL (BAS); BAS plus additional continuous noise (CON); BAS plus square-wave interrupted noise consisting of 10-Hz square-wave interruption with 50% duty cycle and 100% modulation depth (SQW); BAS plus sinusoidal amplitude modulation of noise with a 10-Hz modulation frequency with 100% modulation depth (SAM). FIG. 7B shows the distribution of the amplitude of the speech plus interference signal in dB SPL for both types of processing with Unprocessed on the left and EEQ on the right. The dashed vertical bars indicate the RMS level of each of the signals, and the solid bars indicate the medians. These amplitude distribution plots in FIG. 7B show that the RMS level is the same for EEQ and Unprocessed speech; however the medians of the distributions are shifted to higher levels after EEQ processing.

Figure 8:
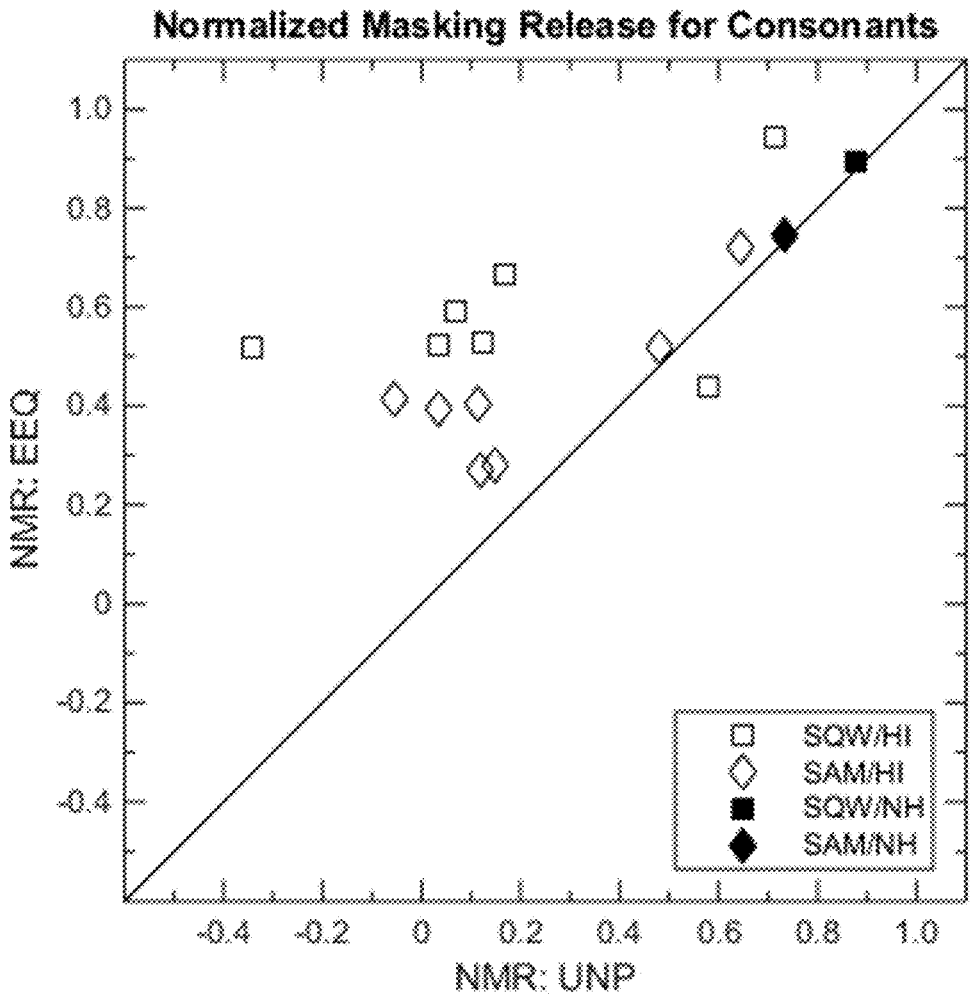
FIG. 8 is a graph showing masking release in processed versus unprocessed conditions.

Results with NH and HI listeners showed the NMR was improved for HI listeners in the SQW noise and the SAM noises. FIG. 8 plots normalized masking release (NMR) for EEQ as a function of NMR for Unprocessed for two types of modulated noise: SQW and SAM. For each HI listener, NMR was higher for EEQ than for Unprocessed for SQW noise (mean NMR of 0.60 for EEQ versus mean NMR of 0.19 for Unprocessed) and for SAM noise (mean NMR of 0.43 for EEQ versus mean NMR of 0.21 for Unprocessed).

Although described in the context of processing a signal plus interference in a hearing prosthesis (e.g., a "hearing aid") for audio or neural (e.g., cochlear) presentation, the EEQ processing is applicable to other situations. In one alternative use, a speech signal is processed for presentation into an acoustic environment, for example, an output audio signal to be presented via a cellphone handset in a noisy environment. Such processing may improve intelligibility for both NH and HI listener by increasing the gain during lower level components of the speech signal, thereby making them more easily perceived and/or recognized in the noisy environment. Similarly, a signal acquired at a device such as a cellphone may be processed using the EEQ technique prior to transmission or other use in order to achieve greater comprehension by a listener.

Implementations of the approach may use analog signal processing components, digital components, or a combination of analog and digital components. The digital components may include a digital signal processor that is configured with processor instructions stored on a non-transitory machine-readable medium (e.g., semiconductor memory) to perform signal processing functions described above.

It is to be understood that the foregoing description is intended to illustrate and not to limit the scope of the invention, which is defined by the scope of the appended claims. Other embodiments are within the scope of the following claims.

What is claimed is:

1. A method for processing an audio signal for presentation to a hearing-impaired listener comprising:

acquiring an input signal in an acoustic environment, the input signal comprising a speech signal of a first speaker and an interfering signal at an average level greater than an average level of the speech signal, the interfering signal having a fluctuating level;

tracking an average level of the input signal over a first averaging duration producing a time-varying first average signal level, wherein the first averaging duration is greater than or equal to 200 milliseconds;

tracking an average level of an input signal over a second averaging duration producing a time-varying second average signal level, wherein the second averaging duration is less than or equal to 5 milliseconds;

determining a first time-varying gain as a ratio of the first average signal level and the second average signal level;

determining a second time-varying gain by limiting the first time-varying gain to a limited range of gain, the limited range excluding attenuation; and applying the second time-varying gain to the input signal to produce a processed input signal; and providing the processed input signal to the hearing-impaired listener.

2. A method for processing an audio signal comprising applying an audio processing process that includes:

tracking an average level of an input signal over a first averaging duration producing a time-varying first average signal level;

tracking an average level of an input signal over a second averaging duration producing a time-varying second average signal level, wherein the second averaging duration is substantially shorter than the first averaging duration;

determining a first time-varying gain according to a degree to which the first average signal level is greater than the second average signal level;

determining a second time-varying gain by limiting the first time-varying gain to a limited range of gain; and applying the second time-varying gain to the input signal producing a processed input signal.

3. The method of claim 2 further comprising:

receiving the input signal, the first signal comprising a speech signal of a first speaker and an interfering signal at an average level greater than an average level of the speech signal, the interfering signal having a fluctuating level.

4. The method of claim 3 further comprising:

acquiring the input signal in an acoustic environment.

5. The method of claim 3 further comprising:

providing the processed input signal for presentation to a hearing-impaired listener.

6. The method of claim 5 wherein providing the processed input signal to the listener comprises driving an acoustic transducer according to the processed input signal.

7. The method of claim 2 further comprising:

further processing the processed input signal, including at least one of a applying a linear time-invariant filter to said signal and applying an amplitude compression to said signal.

8. The method of claim 2 wherein tracking the average level of an input signal over the first averaging duration comprises applying a first filter to an energy of the input signal, the first filter having an impulse response characterized by a duration or time constant equal to the first averaging duration.

9. The method of claim 8 wherein tracking the average level of an input signal over the second averaging duration comprises applying a second filter to the energy of the input signal, the second filter having an impulse response characterized by a duration or time constant equal to the second averaging duration.

10. The method of claim 2 wherein limiting the first time-varying gain to a limited range includes excluding attenuating gain.

11. The method of claim 10 wherein the limited range of gain excludes gain below 0 dB and above 20 dB.

12. The method of claim 2 wherein the processing procedure further comprises:

adjusting an average level of the processed input signal to match the first average signal level.

13. The method of claim 2 further comprising presenting the processed input signal in an environment with an inference that have a varying level.

14. The method of claim 2 further comprising:

decomposing the input signal into a plurality of component signals, each component signal being associated with a different frequency range;

applying the processing procedure to each of the component signals producing a plurality of processed component signals; and combining the processed component signals.

15. An audio processing apparatus comprising:

an audio processor that includes a first level filter configured to track an average level of an input signal over a first averaging duration producing a time-varying first average signal level, a second level filter configured to track an average level of an input signal over a second averaging duration producing a time-varying second average signal level, wherein the second averaging duration is substantially shorter than the first averaging duration, a gain determiner configured to determine a first time-varying gain according to a degree to which the first average signal level is greater than the second average signal level, and to determine a second time-varying gain by limiting the first time-varying gain to a limited range of gain, and a multiplier configured to apply the second time-varying gain to the input signal producing a processed input signal;

a signal acquisition module coupled to a microphone for sensing an acoustic environment, and coupled to an input of the audio processor via a first signal path; and a signal presentation module coupled to a transducer for presenting an acoustic or neural signal to a listener, and coupled to an output of the audio processor via a second signal path.

16. The audio processing apparatus of claim 15 further comprising at least one of a linear time-invariant filter and an amplitude compressor on either the first signal path or the second signal path.

17. The audio processing apparatus of claim 15 wherein the audio processor includes a programmable signal processor, and a storage for instructions for the signal processor.

18. A non-transitory machine-readable medium comprising instructions stored thereon for causing a processor to process an audio signal by:

tracking an average level of an input signal over a first averaging duration producing a time-varying first average signal level;

tracking an average level of an input signal over a second averaging duration producing a time-varying second average signal level, wherein the second averaging duration is substantially shorter than the first averaging duration;

determining a first time-varying gain according to a degree to which the first average signal level is greater than the second average signal level;

determining a second time-varying gain by limiting the first time-varying gain to a limited range of gain; and applying the second time-varying gain to the input signal producing a processed input signal.

* * * * *